US006564785B2

(12) United States Patent
Iwasaki

(10) Patent No.: US 6,564,785 B2
(45) Date of Patent: May 20, 2003

(54) CYLINDER INTAKE-AIR QUANTITY CALCULATING APPARATUS AND METHOD FOR INTERNAL COMBUSTION ENGINE

(75) Inventor: Tetsuya Iwasaki, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/133,356

(22) Filed: Apr. 29, 2002

(65) Prior Publication Data

US 2002/0189595 A1 Dec. 19, 2002

(30) Foreign Application Priority Data

Jun. 14, 2001 (JP) ..... 2001-180518

(51) Int. Cl.[7] ..... F02M 5/00

(52) U.S. Cl. ..... 123/568.21; 123/491; 123/434; 123/435; 73/118.2

(58) Field of Search ..... 123/568.21, 491, 123/434, 435; 73/118.2

(56) References Cited

U.S. PATENT DOCUMENTS

| | | | | |
|---|---|---|---|---|
| 4,911,133 | A | 3/1990 | Sogawa | |
| 6,308,129 | B1 | 10/2001 | Uchida | |
| 6,328,007 | B1 | 12/2001 | Hirasawa et al. | |
| 6,494,185 | B2 * | 12/2002 | Iwasaki et al. | 123/478 |

FOREIGN PATENT DOCUMENTS

| | | |
|---|---|---|
| JP | 61-258942 | 11/1986 |
| JP | 2901613 | 3/1999 |
| JP | 2001-20787 | 1/2001 |
| JP | 2001-50091 | 2/2001 |

OTHER PUBLICATIONS

U.S. patent application Ser. No. 10/058,295, Iwasaki et al., filed Jan. 30, 2002.
U.S. patent application Ser. No. 10/058,294, Iwasaki et al., filed Jan. 30, 2002.
U.S. patent application Ser. No. 10/062,566, Hoshino et al., filed Feb. 5, 2002.

* cited by examiner

*Primary Examiner*—Bibhu Mohanty
(74) *Attorney, Agent, or Firm*—Foley & Lardner

(57) ABSTRACT

In apparatus and method for calculating a mass air quantity sucked into a cylinder of an internal combustion engine, income and outgo calculations between a mass air quantity flowing into an intake manifold and that flowing out from the intake manifold is performed to calculate the mass air quantity within the intake manifold and calculates a mass air quantity sucked into a corresponding cylinder of the engine on the basis of the mass air quantity within the intake manifold and a volume of the corresponding cylinder; and the mass air quantity within the intake manifold calculated as a result of the income and outgo calculations of the mass air quantity during a stop of the engine is corrected on the basis of a crank angular position during a step of the engine to calculate finally the mass air quantity within the intake manifold during the stop of the engine.

19 Claims, 10 Drawing Sheets

CYLINDER INTAKE-AIR QUANTITY CALCULATING APPARATUS AND METHOD FOR INTERNAL COMBUSTION ENGINE

BACKGROUND OF THE INVENTION

1. Field of the Invention

The present invention relates to apparatus and method for calculating a mass air quantity sucked into a cylinder of an internal combustion engine while performing income and outgo calculations of an air mass in an intake manifold on the basis of an output signal of an airflow meter located at an upstream side of the intake manifold.

2. Description of the Related Art

A cylinder intake-air (or sucked air) quantity is calculated with a relationship of a first-order lag to an intake air quantity measured by the airflow meter through a weighted mean process in order to cope with a stepwise variation in an opening angle of a throttle valve, in a normally available engine which controls the intake air quantity through a control over an engine throttle valve to calculate the cylinder intake air quantity. This is exemplified by a Japanese Patent Application First Publication No. Showa 61-258942 published on Nov. 17, 1986.

However, in a variably operated engine valve equipped internal combustion engine which is capable of controlling arbitrarily open-and-closure timings of intake and exhaust valves, a control over timings at which the intake valve is opened or closed and the exhaust valve is opened or closed, particularly, a control of a closure timing of the intake valve causes the cylinder intake-air quantity to be varied in a stepwise manner. Hence, the above-described method cannot calculate, with a high accuracy, the cylinder intake-air quantity.

A Japanese Patent Application First Publication No. 2001-20787 published on Jan. 23, 2001 (which corresponds to a U.S. Pat. No. 6,328,007 issued on Dec. 11, 2001) exemplifies a previously proposed cylinder sucked mass air quantity calculating apparatus. That is to say, the mass air quantity within the intake manifold is calculated by performing income and outgo calculations of the mass air quantity flowing into the intake manifold calculated from the output of the airflow meter and that flowing out into the cylinder. On the other hand, a volumetric air quantity sucked into the cylinder is calculated on the basis of valve open-and-closure timings of the corresponding intake and exhaust valves. Then, the mass air quantity sucked into the cylinder is calculated from the mass air quantity within the intake manifold, an air density calculated from the volume of the intake manifold previously determined, and the volumetric air quantity sucked into the cylinder. According to the above-described method of calculating the cylinder sucked mass air quantity, the cylinder sucked air quantity can accurately be calculated.

SUMMARY OF THE INVENTION

It is preferable to store a calculated value of the mass air quantity within the intake manifold into a memory during a stop of the engine so as to be used for a time during which a restart of the engine is carried out in order to secure sufficiently an accuracy of the above-described cylinder sucked intake-air quantity.

FIG. 12 shows a variation pattern of a total piston stroke variable during a stop of the engine.

As shown in FIG. 12, even after the engine has stopped, the air flows into the intake manifold due to a negative pressure left present in the intake manifold so that the air flows into a portion of connecting the intake manifold to a cylinder volume communicated with the intake manifold until the portion is settled at the atmospheric pressure.

However, since, in the income and outgo calculations of the mass air quantity within the intake manifold, the mass air quantity of the air flowing out from the intake manifold is calculated to give zero after the detection of the engine stop (engine revolution has been stopped), the mass air quantity within the intake manifold calculated during the stop of the engine is resulted in a value of adding in an extra manner the air quantity corresponding to the cylinder volume communicated with the intake manifold.

It is noted that, if a crank angular position during a stop of the engine is placed at a constant position, a volume of the cylinder communicated with the intake manifold is accordingly constant. Therefore, a constant initial value may be given as the mass air quantity within the intake manifold during a re-start of the engine. However, in an actual practice, the crank angular position does not indicate constant due to various types of primary factors.

FIG. 13 shows a total stroke variable (which is approximately proportional to a total cylinder volume) which is a total of stroke variables of respective pistons from its upper top dead center of respective cylinders communicated with the intake manifold with respect to the crank angular position during the stop of the engine. In FIG. 13, a dot-and-dash line denotes the piston stroke variable of each cylinder in which the piston stroke variable is varied in a stepwise manner when the intake valve is started to open so as to be communicated with the intake manifold and when the intake valve is closed to block the communication of the corresponding cylinder with the intake manifold.

FIG. 14 shows a total cylinder volume which is a total of each cylinder communicated with the intake manifold with respect to the crank angular position during the stop of engine 1, in a case of a four-cylinder engine and in a case of a sixth-cylinder engine. The total number volume is approximately proportional to the total stroke variables. As shown in FIG. 14, the total cylinder volume is largely different between maximum cylinder volume and minimum cylinder volume. In general, at a time point at which a plurality of cylinders are communicated with the intake manifold due to a balance of each force, the engine is often stopped (an interval of A shown in FIG. 14). Even in this case, a considerable variation is present. In addition, there is often a case where the engine cylinders are balanced in a state where a connecting rod raised perpendicularly at the upper top dead center receives a compression reaction force (an interval B in FIG. 14).

As described above, if a large variation occurs in the cylinder volume communicated with the intake manifold during the stop of the engine, the initial value of the mass air quantity within the intake manifold during the re-start of the engine cannot accurately be calculated and errors occur in the subsequent income and outgo calculation and the calculation of the cylinder intake-air quantity. A Japanese Patent No. 2901613 issued on Mar. 19, 1999 (which corresponds to a U.S. Pat. No. 4,911,133 issued on Mar. 27, 1990) exemplifies a still another previously proposed cylinder sucked air quantity calculating apparatus in which, when a total weight of the intake-air system located at a downstream side of the throttle valve is calculated, the initial value is calculated with a pressure located downstream of the throttle valve set as the atmospheric pressure. However, in this Japanese Patent, no consideration on which way, specifically, the atmospheric pressure is determined is given and no consideration is given on the cylinder volume communicated with the intake manifold which is different according to the crank angular position.

It is, hence, an object of the present invention to provide cylinder intake-air quantity calculating apparatus for an internal combustion engine which can accurately detect the mass air quantity within the intake manifold during the stop of the engine so that the cylinder sucked air quantity can always accurately be calculated.

According to one aspect of the present invention, there is provided an apparatus for calculating a mass air quantity sucked into one of cylinders of an internal combustion engine, comprising: a cylinder sucked mass air quantity calculating section that calculates a mass air quantity sucked into a corresponding one of the cylinders of the engine on the basis of a mass air quantity within an intake manifold and a volume of the corresponding cylinder while performing income and outgo calculations between a mass air quantity flowing into the intake manifold and that flowing out from the intake manifold to calculate the mass air quantity within the intake manifold; and a correction section that corrects the mass air quantity within the intake manifold calculated as a result of the income and outgo calculations between the mass air quantities during a stop of the engine on the basis of a crank angular position during the stop of the engine to calculate finally the mass air quantity within the intake manifold during the stop of the engine.

According to another aspect of the present invention, there is provided a method for calculating a mass air quantity sucked into one of cylinders of an internal combustion engine, comprising: performing income and outgo calculations between a mass air quantity flowing into an intake manifold and that flowing out from the intake manifold to calculate the mass air quantity within the intake manifold; calculating a mass air quantity sucked into a corresponding cylinder of the engine on the basis of the mass air quantity within the intake manifold and a volume of the corresponding cylinder; and correcting the mass air quantity within the intake manifold calculated as a result of the income and outgo calculations of the mass air quantity during a stop of the engine on the basis of a crank angular position at a time at which the engine has stopped to calculate finally the mass air quantity within the intake manifold during the stop of the engine.

This summary of the invention does not necessarily describe all necessary features so that the invention may also be a sub-combination of these described features.

DETAILED DESCRIPTION OF THE PREFERRED EMBODIMENT

Reference will hereinafter be made to the drawings in order to facilitate a better understanding of the present invention.

Figure 1:
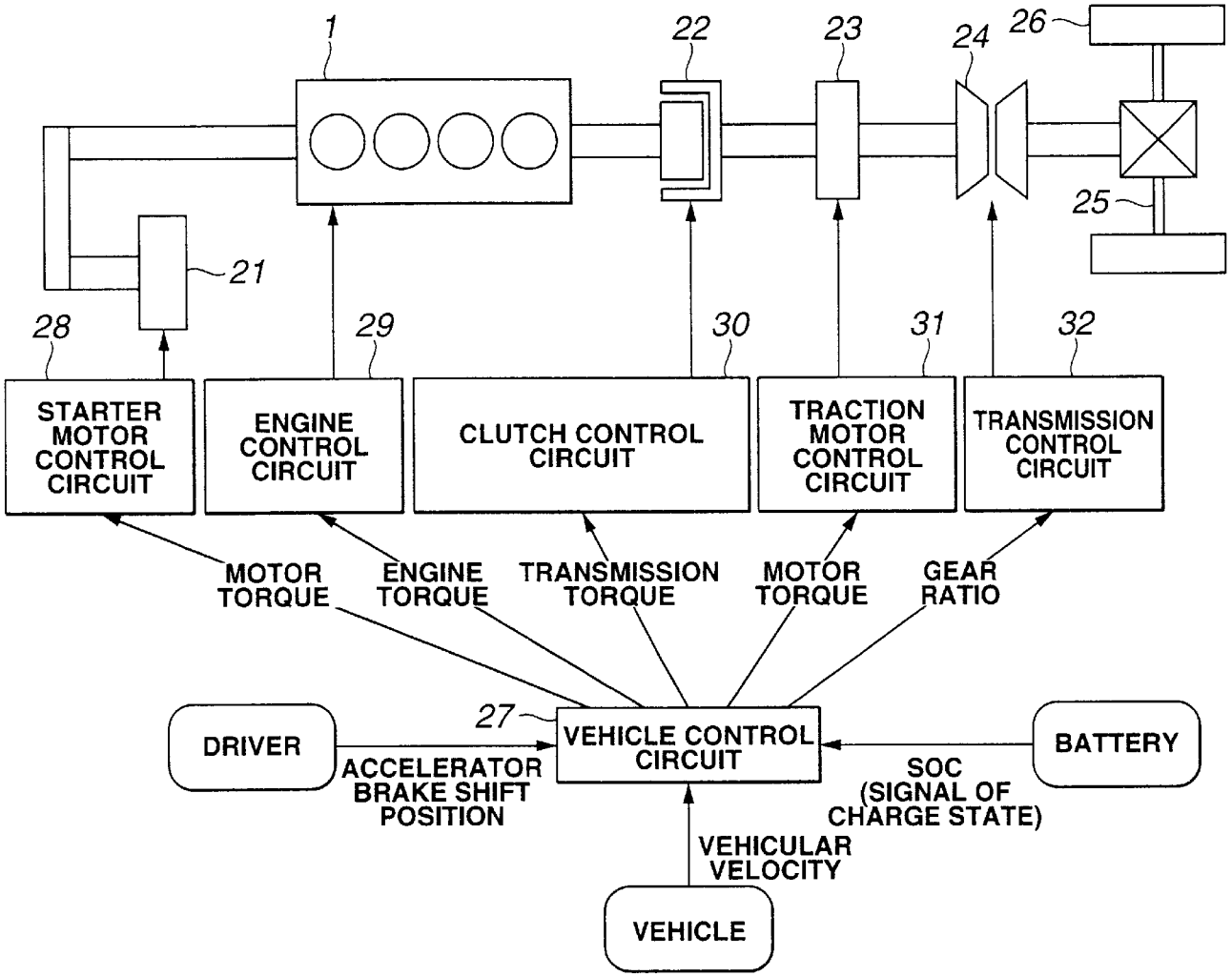
FIG. 1 is a system configuration view of an idle stop system of a hybrid vehicle to which a cylinder sucked mass air quantity calculating apparatus for a variable operated engine valve equipped engine in a preferred embodiment according to the present invention is applicable.

FIG. 1 shows a power train system configuration of a hybrid vehicle in which a variably operated engine valve to which a cylinder sucked mass air quantity calculating apparatus in a preferred embodiment according to the present invention is applicable is mounted.

An output shaft of an engine 1 driven by means of an engine driving motor 21 is connected to a vehicular running purpose motor 23 via a clutch 22 such as a powder clutch so as to enable a power transmission therethrough and a detachment therefrom. An output shaft of the vehicular running motor 23 is connected to drive wheels 26 via transmission gear 24 and differential gear 25. A signal indicating an acceleration, a brake, and a transmission's shift position, each being manipulated by a vehicle driver, a vehicular velocity signal, and a signal indicating a charge state of a battery are inputted to a vehicle control circuit 27. Vehicle control circuit 27 controls each circuit via a driving motor control circuit 28, an engine control circuit 29, a clutch control circuit 30, a vehicular running motor control circuit 31, and a transmission control circuit 32.

In addition, the vehicle is, so-called, an idle stop vehicle in which engine 1 which is stopped due to an improvement in fuel economy under a predetermined idling condition and an improvement in an exhaust purification performance under the predetermined idling condition. Such an idle stop vehicle as described above is exemplified by a U.S. Pat. No. 6,308,129 issued on Oct. 23, 2001(, the disclosure of which is herein incorporated by reference). As shown in FIG. 1, an engine driving motor 21 is connected to a motor driving control circuit 28, a traction motor control circuit 31 is connected to a vehicular running motor 23, a clutch control circuit 30 is connected to clutch 22, transmission gear 24 is connected to a transmission control circuit 32.

Figure 2A:
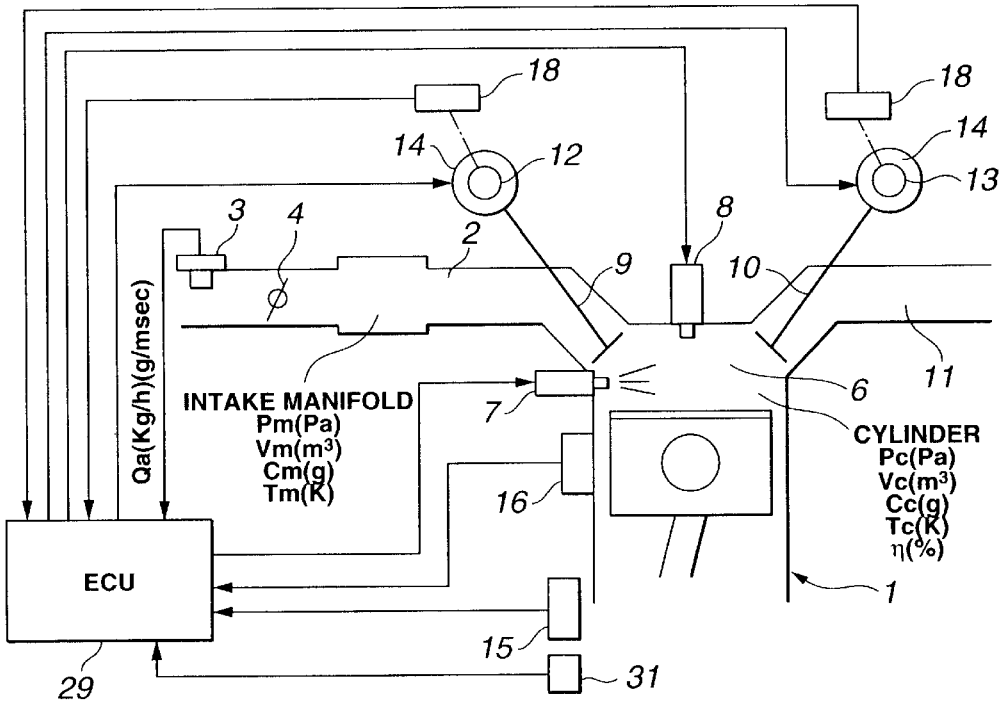
FIG. 2A is a schematic block diagram of the cylinder sucked mass air quantity calculating apparatus for the variably operated engine valve equipped internal combustion engine in the preferred embodiment according to the present invention.

FIG. 2A shows a system configuration of a variably operated engine valve equipped engine 1 to which the cylinder sucked mass air quantity calculating apparatus is applicable. An airflow meter 3 to detect an intake-air quantity Qa is disposed within an intake air passage 2 of engine 1. The intake-air quantity Qa is adjusted through a throttle valve 4.

A spark plug 8 to perform a spark ignition within a combustion chamber 6 is disposed. A fuel injection valve 7 to inject fuel within combustion chamber 6 is disposed. The fuel is injected from fuel injection valve 7(or fuel injector) to air sucked via intake valve 9 to form a mixture fuel so that the mixture fuel is compressed within combustion chamber 6 and the spark ignition through spark plug 8 is ignited. Exhaust gas of engine 1 is exhausted to an exhaust passage 11 from combustion chamber 6 via exhaust valve 10 and discharged into the air through an exhaust purification catalyst and muffler (not shown).

Intake valve 9 and exhaust valve 10 are driven to be opened or closed by means of cams installed on an intake valve side camshaft 12 and an exhaust valve side camshaft 13. A hydraulically driven variable valve timing mechanism 14 (hereinafter, referred to as a VTC mechanism) to advance corrected valve open and closure timings of the intake or exhaust valve is disposed to vary a rotational phase of the camshaft with respect to a crankshaft, respectively.

It is noted that the operations of throttle valve 4, fuel injection valve 7, and spark plug 8 are controlled by means of ECU (Electronic Control Unit) 29 and ECU 29 receives signals from crank angle sensor 15, camshaft sensors 18, coolant temperature sensor 16, and airflow meter 3. In addition, ECU 29 detects rotational phase (VTC phase) of intake camshaft 12 with respect to the crankshaft on the basis of detection signals from intake side and exhaust side camshaft sensors 18, detects the rotational phase (VTC phase) of the exhaust camshaft 13 with respect to the crankshaft to detect the open-and-closure timings (IVO, IVC, EVO, and EVC) of the intake valve 9 and exhaust valve 10, determines target phase angles (advance angle value or retardation angle value) of intake side camshaft 12 and exhaust side camshaft 13 on the basis of an engine load, an engine speed Ne, and a coolant temperature Tw, and controls the open-and-closure timings of intake and exhaust valves 9 and 10. Furthermore, aside from crank angle sensor 15, an encoder 31 to accurately detect a crank angular position (absolute position) during the stop of engine 1 according to the present invention is installed. The detection signal is inputted into ECU 29.

Fuel injection timing and fuel injection quantity of fuel injection valve (fuel injector) 7 are controlled on the basis of engine driving condition. The fuel injection quantity is controlled so as to provide a desired air fuel ratio for a cylinder intake-air quantity (cylinder sucked mass air quantity) Cc calculated as will be described later on the basis of an intake-air quantity (mass flow quantity) Qa measured by airflow meter 3. The ignition timing by means of spark plug 8 is controlled so as to reach to an MBT (Minimum advance for Best Torque) or to reach to a knocking limit.

Next, a detailed description of a calculation of the cylinder intake-air (sucked air) quantity Cc (viz., a mass air quantity sucked into the cylinder) used to control a fuel injection quantity or so on will be made with reference to a series of flowcharts of FIGS. 3 to 11.

It is noted that, as shown in FIG. 2A, the intake-air quantity (mass flow quantity) measured by airflow meter 3 is supposed to be Qa (in a unit of Kg/h) but the unit is converted by a multiplication of Qa (Kg/h) with 1/3600 into Qa (in a unit of g/msec.).

In addition, suppose that a pressure in intake manifold is denoted by Pm (Pa), a volume thereof is denoted by Vm ($m^3$: constant), mass air quantity is denoted by Cm (g), and an intake temperature is denoted by Tm (K), and a fresh-air rate within a corresponding cylinder is denoted by $\eta$ (%).

Furthermore, suppose that a pressure in the cylinder portion is denoted by Pc (Pa), a volume therein is denoted by Vc ($m^3$), a mass air quantity therein is denoted by Cc(g), and a temperature therein is denoted by Tc (K). Then, the fresh-air rate within the cylinder is denoted by $\eta$ (%).

Suppose, then, that Pm=Pc and Tm=Tc (pressure and temperature between the intake manifold and the cylinder are not varied).

Figure 3:
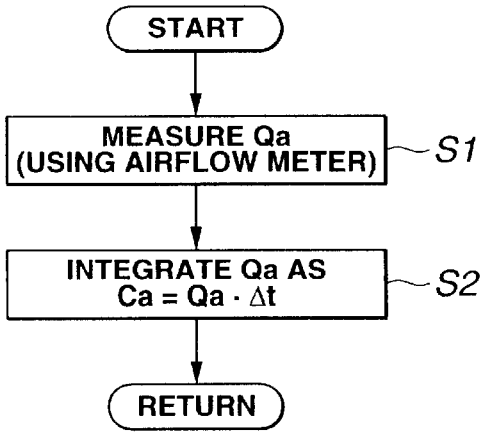
FIG. 3 is an operational flowchart representing a calculation routine of a mass air quantity flowing into an intake manifold (Ca).

FIG. 3 shows an operational flowchart to calculate an air quantity Ca flowing into the intake manifold which is executed for each predetermined period of time $\Delta t$.

At a step S1, ECU 29 (or hereinafter also called, a controller) measures intake-air quantity Qa (the unit is mass flow quantity of g/msec) from an output signal from airflow meter 3.

At a step S2, ECU (controller) 29 integrates an intake-air quantity of Qa to calculate air quantity Ca (air mass; g) flowing into manifold for each predetermined period of time $\Delta t$ (that is to say, a cycle time of the routine shown in FIG. 3 and $Ca=Qa\cdot\Delta t$).

Figure 4:
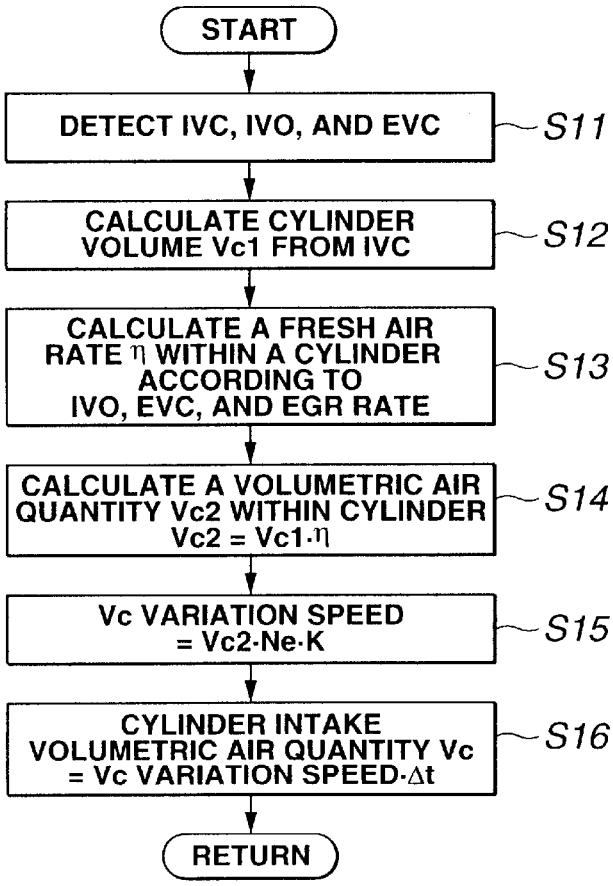
FIG. 4 is an operational flowchart representing a calculation routine of a cylinder sucked volumetric air quantity.

FIG. 4 shows an operational flowchart representing a calculation routine of cylinder sucked volume air quantity Vc and which is executed by ECU 29 (controller) for each predetermined period of time $\Delta t$. At a step S11, controller 29 detects closure timing IVC and open timing IVO of intake valve 9 and closure timing EVC of exhaust valve 10. It is noted that these timings may directly be detected by means of lift sensors installed on intake valve 9 and exhaust valve 10 but may be simplified by using control command values (target values) issued from ECU 29.

Then, at a step S12, controller 29 calculates the cylinder volume $Vc_1$ at a time of the closure timing IVC of intake valve 9 from the closure timing IVC of intake valve 9. The calculated cylinder volume is a target $Vc_1$ ($m^3$). At a step S13, controller 29 calculates internal cylinder fresh-air rate $\eta$ (%) from open timing IVO of the intake valve 9, closure timing EVC of exhaust valve 10, and an EGR (Exhaust Gas Recirculation) rate if required. In details, a valve overlap quantity is determined according to open timing IVO of intake valve 9 and closure timing EVC of exhaust valve 10. As the overlap quantity becomes large, a residual gas (internal EGR quantity) becomes large. Hence, internal cylinder fresh-air rate $\eta$ is derived on the basis of the overlap quantity. In addition, in the engine equipped with a variably operated engine valve (so-called, a variable valve timing device), a control of the overlap quantity enables a control of internal EGR flexibly. Hence, in general, an EGR device (external EGR) is not provided. If provided, furthermore, a final internal cylinder fresh-air rate $\eta$ is determined with a correction of $\eta$ by the EGR rate in a case where the external EGR rate is installed.

At the next step S14, controller 29 calculates internal cylinder volume air quantity $Vc_2$ ($m^3$). That is to say, at step S14, controller 29 multiplies $Vc_1$ by fresh air rate $\eta$ within the cylinder to calculate $Vc_2$ ($m^3$)=$Vc1\cdot\eta$ ($Vc_1$: cylinder volume and $\eta$: internal cylinder volume air quantity).

At a step S15, controller 29 multiplies internal cylinder volume air quantity $Vc_2$ ($m^3$) by engine speed Ne (rpm) to calculate a variation velocity of Vc (volumetric flow quantity; $m^3$/msec). Vc variation velocity=actual Vc·Ne·K, wherein K denotes a constant to convert different units into a single unit and K=1/30×(1/1000), 1/30 is a conversion of Ne (rpm) into Ne (180 deg/sec) and 1/1000 is a conversion of Vc ($m^3$/sec) and 1/1000 is a conversion of Vc ($m^3$/sec) to Vc ($m^3$/msec).

In addition, in a case where such a control as a stop of apart of cylinders is executed, variation velocity of Vc is given by the following equation: Vc variation velocity= actual Vc·Ne·K·n/N. In this equation, n/N denotes a ratio of operation when a part of cylinders is stopped, N denotes the number of cylinders, n denotes a number of cylinders in operation. Hence, in a case where four-cylinder engine and one cylinder is not operated, n/N=3/4. It is noted that, in a case where the operation of a particular cylinder is stopped, a fuel supply to the particular cylinder is cut off with each of intake valve (s) and exhaust valve(s) held in a full closure state.

At a step S16, controller 20 integrates Vc variation rate (speed) (volumetric flow quantity; $m^3$/sec) and calculates cylinder volumetric air quantity Vc($m^3$)=Vc variation velocity·Δt which is an air quantity sucked into a cylinder per unit time (one millisecond).

Figure 5:
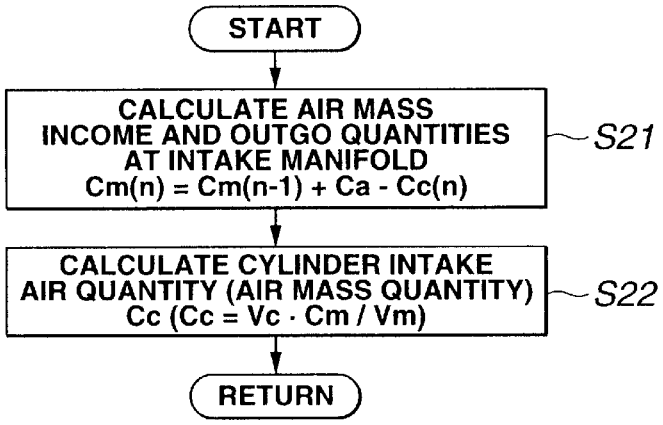
FIG. 5 is an operational flowchart representing a continuous calculation of income and outgo calculation of an intake-air within an intake manifold and cylinder sucked mass air quantity.
Figure 6:
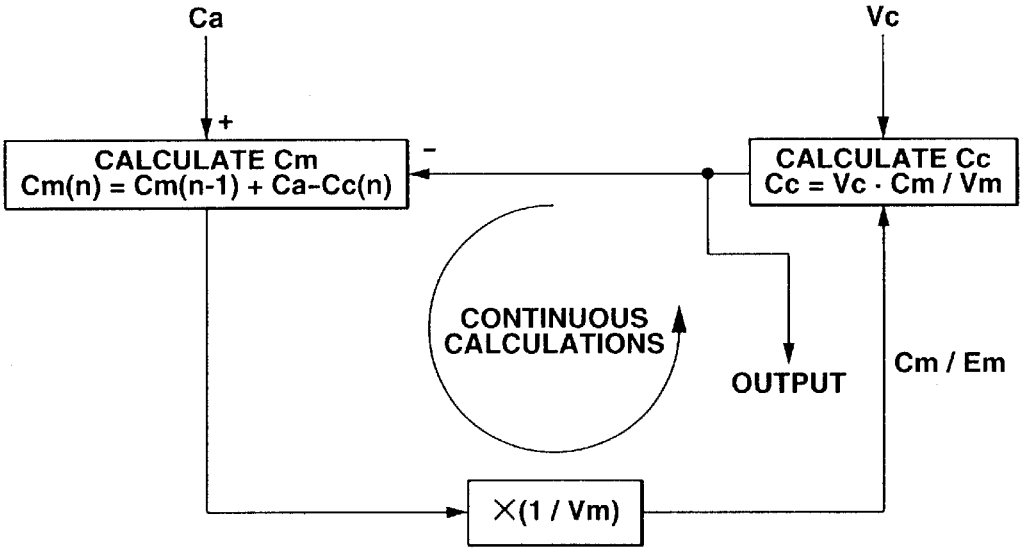
FIG. 6 is a block diagram representing the continuous calculation shown in FIG. 5.

FIG. 5 shows a flowchart of a continuous calculation (calculations on a manifold intake-air income and outgo and cylinder mass air quantity Vc) and executed repeatedly for each predetermined period of time Δt. In addition, FIG. 6 shows a block diagram representing a continuous calculation section executed as shown in FIG. 5.

At a step S21, controller 29 adds mass air quantity Ca (=Qa·Δt) flowing into the intake manifold determined at the routine of FIG. 3 to a previous value Cm(n−1) of mass air quantity of manifold as shown in the following equation for the income and outgo calculations in the manifold (income and outgo calculations of mass air quantity in the manifold). In addition, mass air quantity Cc(n) which is the cylinder intake-air quantity flowing out from the manifold to the cylinder is subtracted from the addition of the previous value Ca (=Qa·Δt) to derive manifold mass air quantity Cm(n)(g).

That is to say, $$Cm(n)=Cm(n-1)+Ca-Cc(n).$$

It is noted that Cc(n) used herein is Cc calculated at the next step 22 at the previous routine.

At a step S22, controller 29 calculates cylinder intake-air quantity (cylinder mass air quantity Cc). As described in the following equation (1), cylinder volume air quantity Vc determined at the routine of FIG. 4 is multiplied by mass air quantity Cm of manifold and is divided by manifold volume Vm (constant value) to determine mass air quantity Cc(g) of cylinder.

That is to say, $$Cc=Vc\cdot Cm/Vm \quad (1).$$

The equation (1) can be derived in the following way.

Since, according to a gaseous state equation, i.e., P·V= C·R·T, C=P·V/(R·T), Cc in the intake manifold is resulted in $$Cc=Pc\cdot Vc/(R\cdot Tc) \quad (2).$$

Suppose that Pc=Pm and Tc=Tm, $$Cc=Pm\cdot Vc/(R\cdot Tm) \quad (3).$$

On the other hand, since, according to the gaseous state equation of P·V=C·R·T, P/(R·T)=C/V. Hence, in the case of the intake manifold portion, $$Pm/(R\cdot Tm)=Cm/Vm \quad (4).$$

If equation (4) is substituted into equation (3), Cc=Vc·[Pm/(R·Tm)]=Vc·[Cm/Vm]. Consequently, the above-described equation (1) can be derived.

As described above, by repeatedly executing steps S21 and S22, i.e., by carrying out the continuous calculations in the way as shown in FIG. 6, the cylinder mass air quantity Cc(g) which is the cylinder sucked air quantity can be derived and outputted. It is noted that the continuous calculations shown in FIG. 6 is continued until intake-air quantity Qa gives zero even after the cylinder mass air quantity Cc gives zero with engine 1 stopped. Although the detailed reason is omitted herein, the atmospheric pressure during the stop of engine 1 is estimated utilizing the calculated value of the mass air quantity Cm of the intake manifold at a time at which the intake air quantity Qa indicates zero. It is noted that the processing order of steps S21 and S22 may be reversed.

Figure 7:
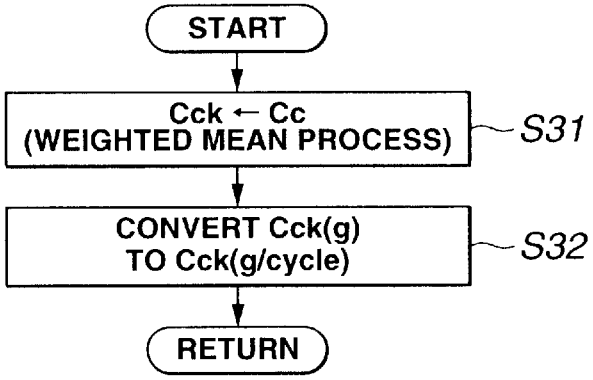
FIG. 7 is an operational flowchart of an example of a post-processing routine after the continuous calculation shown in FIGS. 5 and 6.

FIG. 7 shows an operational flowchart of a post-processing routine.

At a step S31, a weighted mean process of cylinder mass air quantity Cc(g) is executed to calculate Cck(g).

$$Cck=Cck\times(1-M)+Cc\times M,$$

wherein M demotes a weighted mean constant and 0<M<1.

At a step S32, in order to synchronize a cylinder mass air quantity Cck(g) with an engine cycle on the basis of which the fuel injection is advanced, cylinder mass air quantity Cck(g) after the weighted mean process execution, engine speed Ne (rpm) is used; namely, Cck (g/cycle)=Cck/(120/Ne). Consequently, Cck(g) is converted into cylinder mass air quantity (g/cycle) for each cycle (two revolutions=720 degrees). It is noted that the weighted mean process can provide a compatibility between a control accuracy and a control response characteristic if the weighted mean process is limitedly used when a ripple of intake-air flow is large as in a state where the throttle valve is largely opened (at a full open position).

Figure 8:
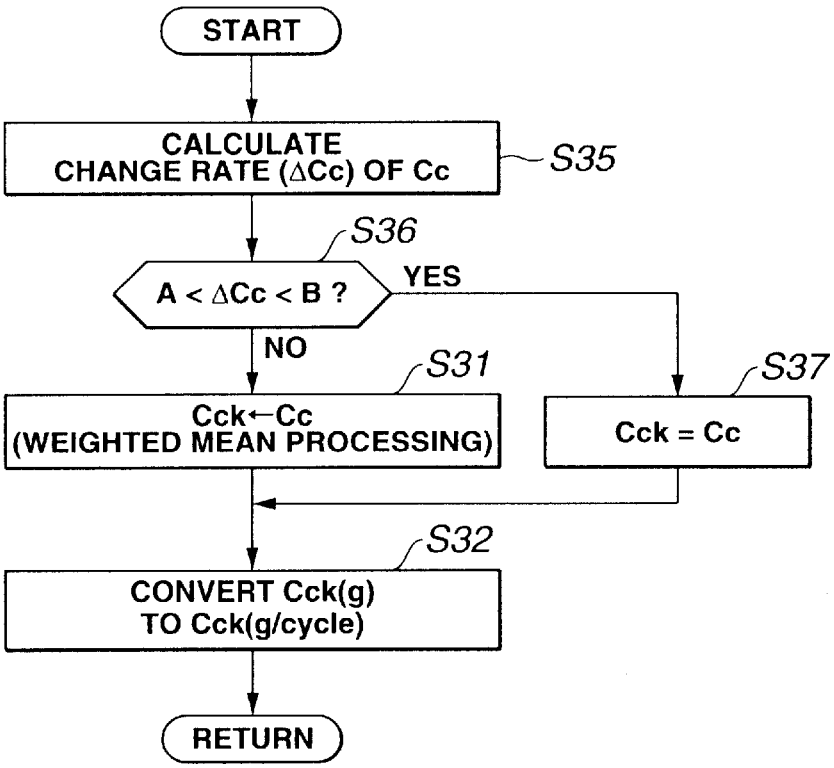
FIG. 8 is an operational flowchart of another example of the post-processing routine after the continuous calculation shown in FIGS. 5 and 6.

FIG. 8 shows an operational flowchart of a post-procedure routine in the case of the weighted mean process.

At a step S35, controller 29 calculates a variation rate ΔCc of cylinder mass air quantity Cc(g). At a step S36, controller 20 determines if variation rate ΔCc falls within a predetermined range (A<ΔCc <B, wherein ΔCc falls within a predetermined range (A<ΔCc<B, ΔCc is greater than A but is smaller than B). If Yes at step S36, the routine goes to a step S37 at which Cck=Cc since no weighted mean is needed. Then, the routine goes to a step S32 in FIG. 10. At step S32, controller 20 converts Cck(g) to Cckg (g/cycle) for each cycle (two revolutions=720 degrees) in the same manner as step S32 in FIG. 7.

Figure 10:
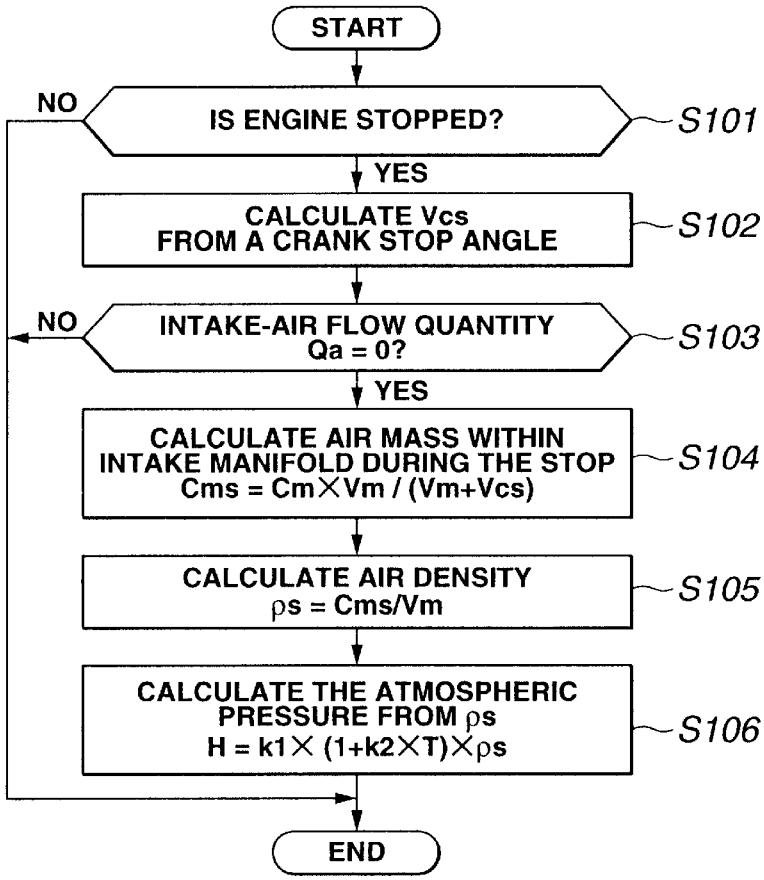
FIG. 10 is an operational flowchart representing a subroutine on the same control shown in FIG. 9.

If variation rate ΔCc falls out of the predetermined range (No) at step S36, controller 29 executes the weighted mean of cylinder mass air quantity Cc(g) at step S31 in FIG. 10 in the same manner as step S31 in FIG. 7 to calculate Cck(g). Then, the routine goes to step S32 in FIG. 8.

Figure 9:
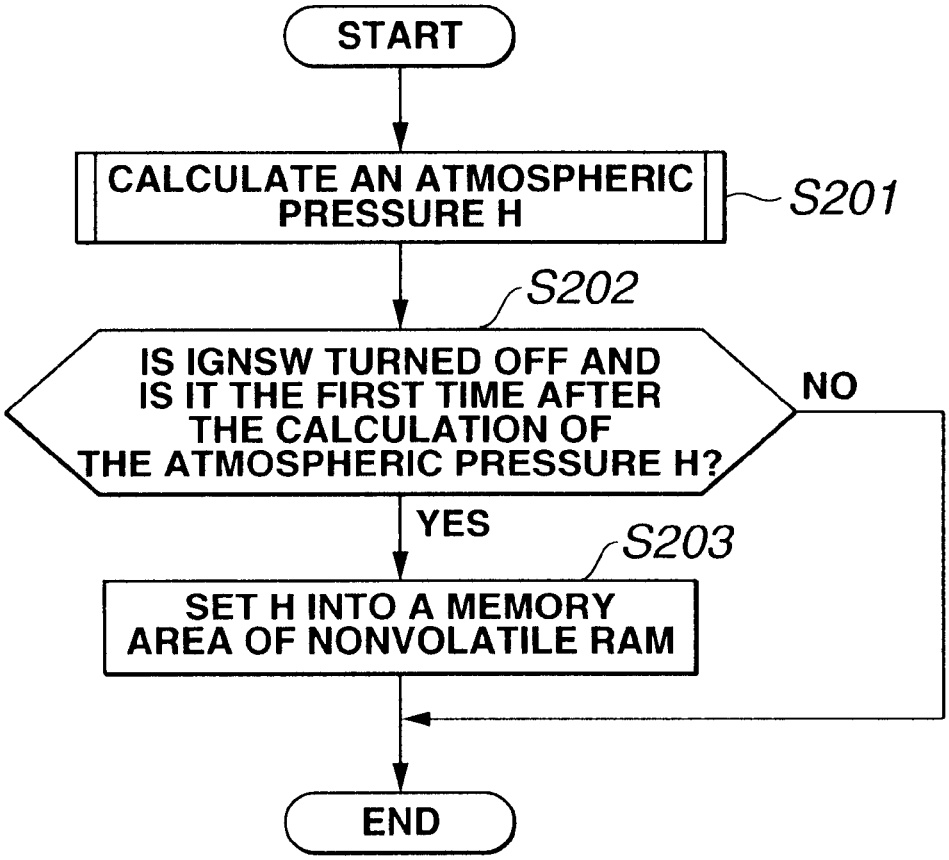
FIG. 9 is an operational flowchart representing a main routine of a control during a stop of the engine.

Next, such a control according to the present invention that the mass air quantity in the intake manifold is highly accurately calculated during the stop of engine 1 so as to be reflected on the income and outgo calculations in the intake manifold at the time at which engine 1 is restarted. FIG. 9 shows a main routine of the above-described control procedure at the time at which engine 1 stops.

At a step S201, ECU 29 calculates mass air quantity in the intake manifold and atmospheric pressure H during the stop of engine 1.

FIG. 10 shows a subroutine of step S201 shown in FIG. 9. At a step S101, ECU 29 determines whether the engine revolution is stopped (engine 1 stops) on the basis of the output signal of crank angle sensor 12.

If ECU 29 determines that engine 1 has stopped, the routine goes to step S102. At step S102, ECU 29 calculates cylinder volume Vcs communicated with the intake manifold according to the crank angular position θs at the time at which engine 1 stops detected by encoder 31. Specifically, it is easily carried out to search a map for cylinder volume Vcs corresponding to crank angular position θs which is previously stored map. At a step S103, ECU 29 determines whether intake-air quantity Qa detected by airflow meter 14 has reached to zero. If intake-air quantity Qa=0 (Yes) at step S103, the subroutine goes to a step S104. At step S104, ECU 29 calculates final intake manifold internal mass air quantity Cms during the stop of engine 1 from the following equation: $Cms=Cm\times Vm/(Vm+Vcs)$.

It is noted that Cm at the first term of a right side of the above-described equation corresponds to a newest intake manifold internal mass air quantity Cm calculated at step S21 in FIG. 5. As described above, Cm calculated during the stop of engine 1 is derived by adding in a surplus manner the air quantity sucked into cylinder volume Vcs communicated with the intake manifold as the air quantity within the intake manifold. Therefore, according to the above-described equation of $Cms=Cm\times Vm/(Vm+Vcs)$, mass air quantity Cms in the intake manifold during the actual stop of engine 1 is calculated by subtracting the air quantity sucked into cylinder volume Vcs from Cm. At a step S105, ECU 29 calculates air density ρs using the following equation. $\rho s=Cms/Vm$. At a step S106, the atmospheric pressure H is calculated using the following equation from air density ρs. That is to say, $H=K1\times(1+k2+T)\times\rho s$, wherein T denotes intake air temperature during the stop of engine 1 and k1 and k2 denote constants determined from the state equation.

Referring back to FIG. 9, at a step S202, controller 29 determines whether ignition switch (IGN SW) is turned to OFF (during the idle stop or during an operation of the ignition switch by the driver) and this is the first time since ECU 29 has calculated the atmospheric pressure at step S106. If the above-described condition is satisfied (Yes) at step S202, the routine goes to a step S203 at which the calculated atmospheric pressure H is set in the non-volatile memory as Hbu.

Figure 11:
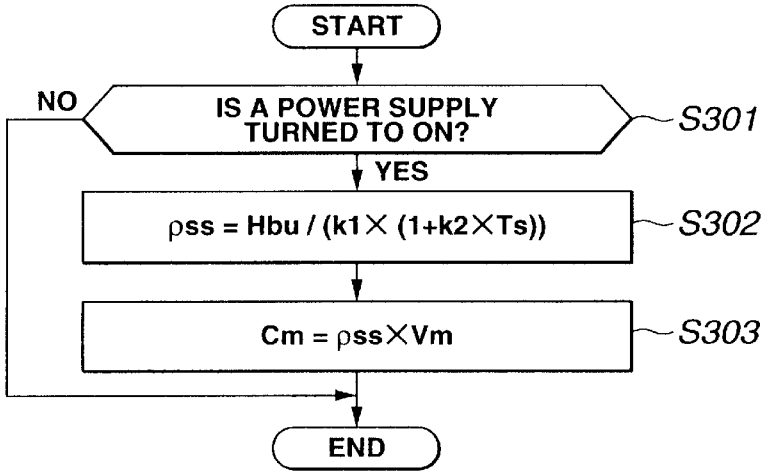
FIG. 11 is an operational flowchart representing a control routine during a re-start of the engine.
Figure 12:
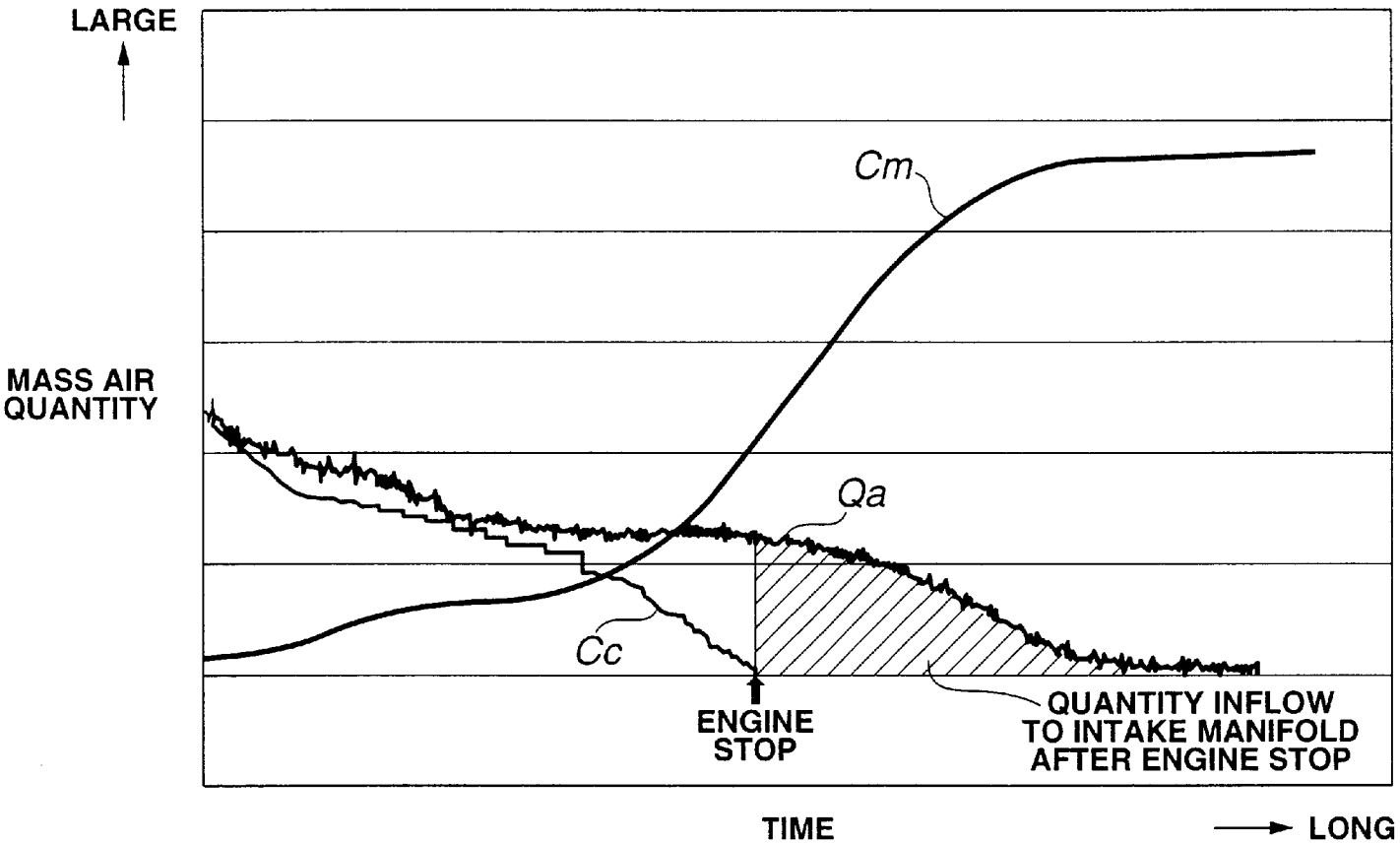
FIG. 12 is a diagram representing a variation in air quantities of respective parts during the stop of the engine.
Figure 13:
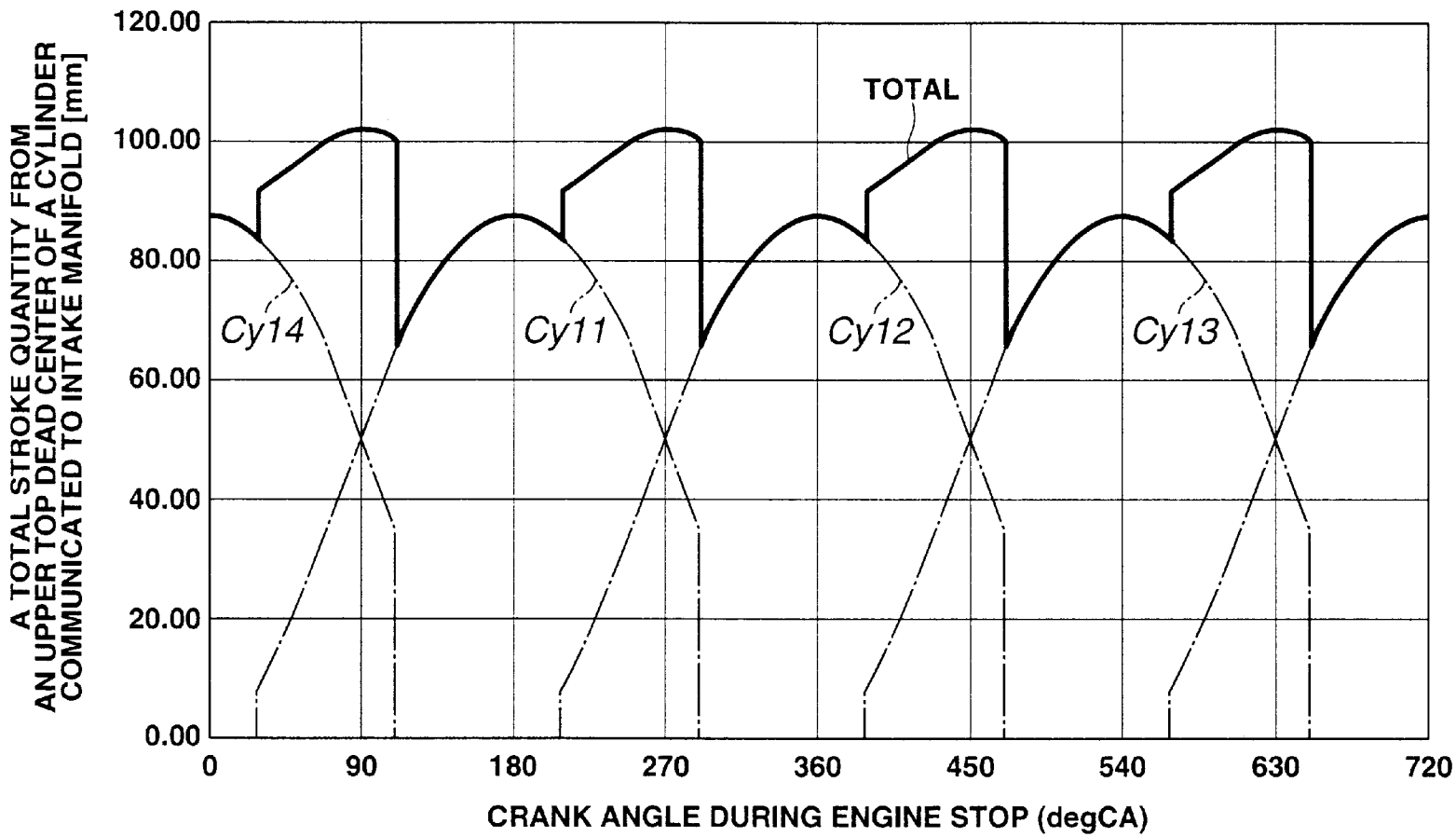
FIG. 13 is a diagram representing a total stroke variable from an upper top dead center of a cylinder communicated with the intake manifold with respect to a crank angular position during the stop of the engine.
Figure 14:
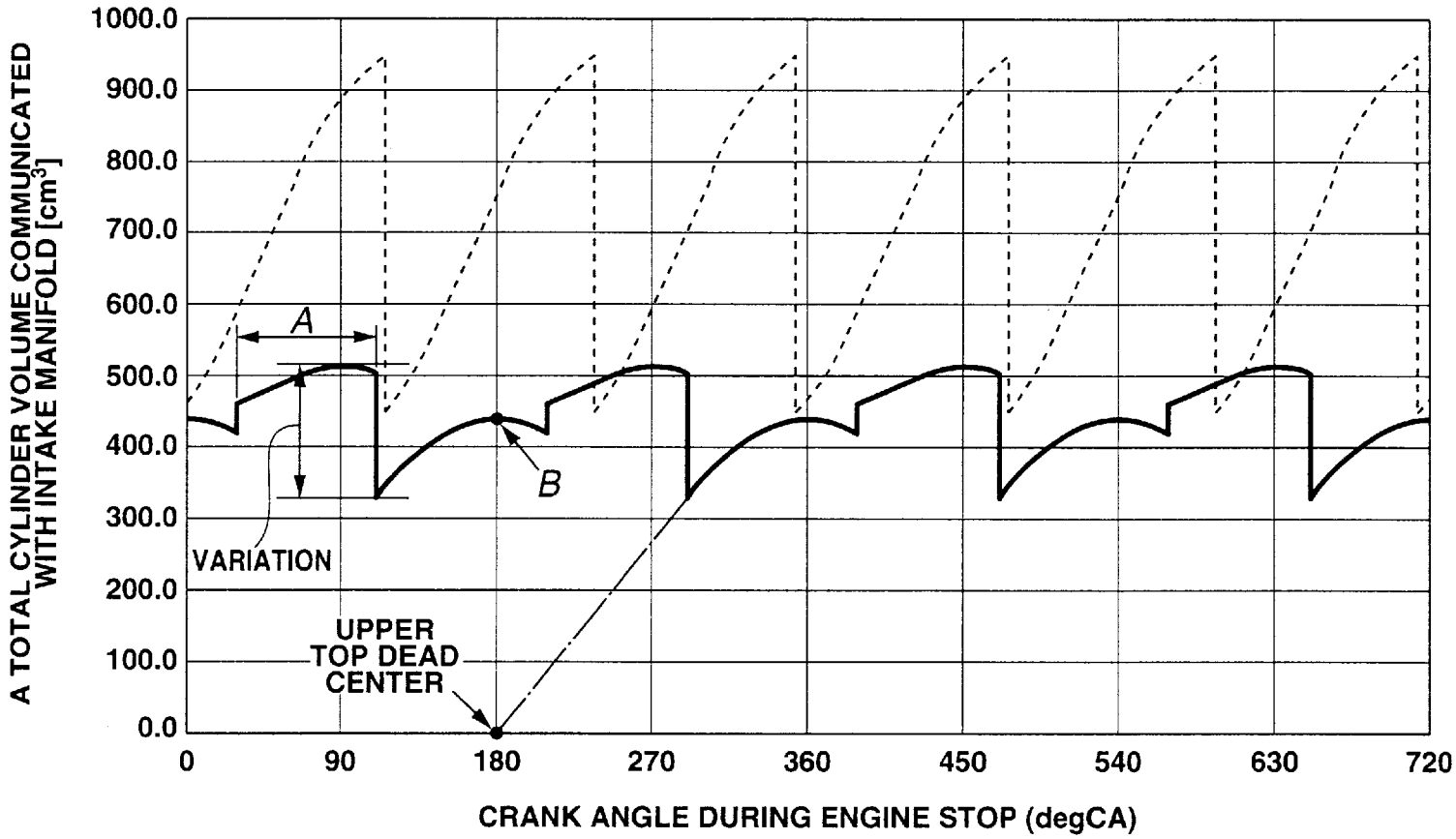
FIG. 14 is a diagram representing a total volume of the cylinder communicated with the intake manifold with respect to the crank angular position during the stop of the engine.

FIG. 11 shows a routine to calculate an initial value of mass air quantity Cm within intake manifold during are-start operation on the basis of the atmospheric pressure calculated during the stop of engine 1.

At a step S301, ECU 29 determines whether it is the first time after the power supply is turned on (the ignition switch is turned to ON). If it is the first time (Yes) at step S301, the routine goes to a step S302. At step S302, ECU 29 calculates air density ρss during the start of engine 1 according to the following equation using the atmospheric pressure Hbu calculated and stored during the engine stop.

$\rho ss=Hbu/[k1\times(1+k2\times Ts)]$, wherein Ts denotes an intake air temperature during the start of engine and k1 and k2 denote above-described constants. At step S302, ECU 29 calculates the initial value of the mass air quantity Cm within the intake manifold at the time of the start of engine 1 on the basis of the air density ρss during the start of engine 1. That is to say, $Cm=\rho ss\times Vm$.

In the way described above, the mass air quantity within the intake manifold during the stop of engine 1 can accurately be calculated, the initial value of the mass air quantity within the intake manifold during the restart operation on the basis of the calculated value of the mass air quantity can accurately be calculated, and cylinder intake-air (sucked air) quantity Cc can always accurately be calculated. It is noted that, since, in the embodiment, the atmospheric pressure is calculated whenever engine 1 is stopped and mass air quantity Cm within the intake manifold is calculated again using the detected value of the intake-air temperature whenever engine 1 is restarted, it is particularly effective when the atmospheric pressure and intake-air temperature are varied during the vehicular drive such as during the vehicular run along a mountain path.

However, during the idle stop ion an ordinary vehicular run (a flat run), it can be assumed that both of the atmospheric pressure and intake-air temperature are not so varied. For a simplicity, with mass air quantity Cm (step S104) within the intake manifold finally calculated during the stop of engine 1 temporarily stored, the temporarily stored mass air quantity Cm may only be used directly as the initial value. In this case, the corresponding advantage can be obtained, the intake-air temperature sensor can be eliminated, and the calculation load can be relieved.

Figure 2B:
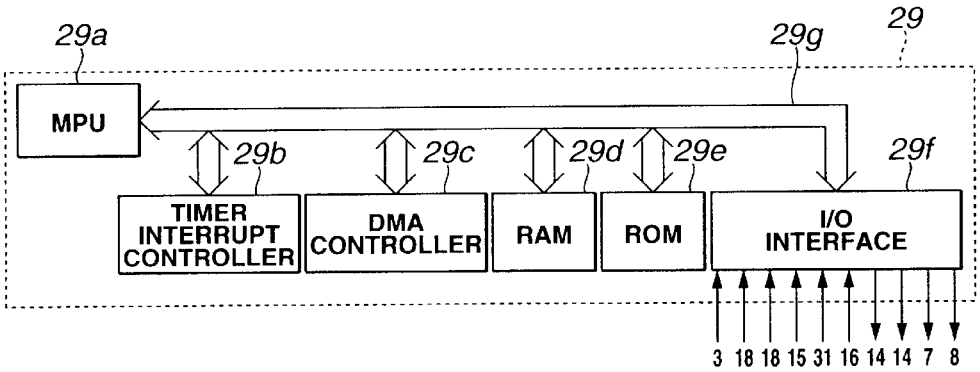
FIG. 2B is a schematic block diagram of an Electronic Control Unit (ECU) shown in FIG. 2A.

It is noted that controller (ECU) 29, as shown in FIG. 2B, includes a microcomputer having a Microprocessor Unit (MPU) 29*a*, a timer interrupt controller 29*b*, a DMA (Direct Memory Access) controller 29*c*, RAM (Random Access Memory) 29*d*, ROM (Read Only Memory) 29*e*, and I/O (Input/Output) interface 29*f*, and a common bus 29*g*.

The entire contents of a Japanese Patent Application No. 2001-180518 (filed in Japan on Jun. 14, 2001) are herein incorporated by reference. Various modifications and variations can be made without departing from the sprit of the present invention. The scope of the invention is defined with reference to the following claims.

What is claimed is:

1. An apparatus for calculating a mass air quantity sucked into one of cylinders of an internal combustion engine, comprising:

a cylinder sucked mass air quantity calculating section that calculates a mass air quantity sucked into a corresponding one of the cylinders of the engine on the basis of a mass air quantity within an intake manifold and a volume of the corresponding cylinder while performing income and outgo calculations between a mass air quantity flowing into the intake manifold and that flowing out from the intake manifold to calculate the mass air quantity within the intake manifold; and a correction section that corrects the mass air quantity within the intake manifold calculated as a result of the income and outgo calculations between the mass air quantities during a stop of the engine on the basis of a crank angular position during the stop of the engine to calculate finally the mass air quantity within the intake manifold during the stop of the engine.

2. An apparatus for calculating a mass air quantity sucked into one of cylinders of an internal combustion engine as claimed in claim 1, wherein the correction section comprises: a cylinder volume calculating section that calculates the volume of the corresponding cylinder which is communicated with the intake manifold on the basis of the crank angular position during the stop of the engine; and a final mass air quantity calculating section that calculates finally the mass air quantity within the intake manifold during the stop of the engine on the basis of the volume of the cylinder and a volume of the intake manifold.

3. An apparatus for calculating a mass air quantity sucked into one of cylinders of an internal combustion engine as claimed in claim 2, wherein the final mass air quantity calculating section calculates finally the mass air quantity within the intake manifold during the stop of the engine on the basis of the mass air quantity within the intake manifold performed by the income and outgo calculations therebetween, the volume of the corresponding cylinder communicated with the intake manifold during the stop of the engine, and the volume of the intake manifold, when a detected value of the mass air quantity flowing into the intake manifold gives zero.

4. An apparatus for calculating a mass air quantity sucked into one of cylinders of an internal combustion engine as claimed in claim 1, further comprising a storing section in which the volume of the corresponding cylinder which is communicated with the intake manifold is stored with respect to the crank angular position and wherein, when the correction section finally calculates the mass air quantity within the intake manifold during the stop of the engine, the correction section refers to the stored volume of the corresponding cylinder in the storing section.

5. An apparatus for calculating a mass air quantity sucked into one of cylinders of an internal combustion engine as claimed in claim 1, wherein the cylinder sucked mass air quantity calculating section uses the mass air quantity within the intake manifold during the stop of the vehicle finally calculated by the correction section as an initial value of the mass air quantity within the intake manifold during a re-start of the engine.

6. An apparatus for calculating a mass air quantity sucked into one of cylinders of an internal combustion engine as claimed in claim 1, further comprising an atmospheric pressure calculating section that calculates the atmospheric pressure on the basis of the mass air quantity within the intake manifold during the stop of the engine finally calculated by the correction section.

7. An apparatus for calculating a mass air quantity sucked into one of cylinders of an internal combustion engine as claimed in claim 1, further comprising an atmospheric pressure calculating section that calculates the atmospheric pressure on the basis of the mass air quantity within the intake manifold finally calculated by the correction section during the stop of the engine and a detected value of an intake air temperature during the stop of the engine.

8. An apparatus for calculating a mass air quantity sucked into one of cylinders of an internal combustion engine as claimed in claim 6, wherein the cylinder sucked mass air quantity calculating section uses the atmospheric pressure calculated by the atmospheric pressure calculating section during the stop of the engine as an initial value of the mass air quantity within the intake manifold in the income and outgo calculations therebetween during a re-start of the engine.

9. An apparatus for calculating a mass air quantity sucked into one of cylinders of an internal combustion engine as claimed in claim 6, further comprising an initial value calculating section that calculates an initial value of the mass air quantity within the intake manifold during a re-start of the engine on the basis of the atmospheric pressure calculated during the stop of the engine and a detected value of an intake air temperature during the re-start of the engine.

10. An apparatus for calculating a mass air quantity sucked into one of cylinders of an internal combustion engine as claimed in claim 1, wherein the crank angular position during the stop of the engine is detected by means of a rotary encoder.

11. An apparatus for calculating a mass air quantity sucked into one of cylinders of an internal combustion engine as claimed in claim 1, further comprising a cylinder sucked volumetric air quantity calculating section that calculates a volumetric air quantity sucked into the corresponding cylinder on the basis of the volume of the corresponding cylinder at a time at which a corresponding intake valve is closed and an internal cylinder refresh air rate thereat and wherein the cylinder sucked mass air quantity calculating section calculates the mass air quantity sucked into the corresponding cylinder of the engine on the basis of the volumetric air quantity sucked into the corresponding cylinder, the mass air quantity within the intake manifold, and a volume of the intake manifold.

12. An apparatus for calculating a mass air quantity sucked into one of cylinders of an internal combustion engine as claimed in claim 11, wherein the internal cylinder fresh air rate is calculated from an open timing of the corresponding intake valve, a closure timing of a corresponding exhaust valve, and an EGR rate of the engine.

13. An apparatus for calculating a mass air quantity sucked into one of cylinders of an internal combustion engine as claimed in claim 1, further comprising a cylinder sucked volumetric air quantity calculating section that calculates an internal cylinder volumetric air quantity $Vc_2$ on the basis of the volume of the corresponding cylinder and an internal cylinder fresh air rate at a time at which a corresponding intake valve is closed, calculates a Vc variation speed on the basis of the internal cylinder volumetric air quantity, and calculates a cylinder sucked volumetric air quantity Vc on the basis of the Vc variation speed.

14. An apparatus for calculating a mass air quantity sucked into one of cylinders of an internal combustion engine as claimed in claim 1, wherein the cylinder sucked mass air quantity calculating section comprises; an intake manifold mass air quantity calculating section that calculates the mass air quantity within the intake manifold Cm(n) by adding the mass air quantity flowing into the intake manifold to a previous value of the mass air quantity within the intake manifold Cm(n−1) and by subtracting the cylinder sucked mass air quantity Cc(n) flowing out from the intake manifold into the corresponding cylinder from an added result of the mass air quantity flowing into the intake manifold to the previous value of the mass air quantity within the intake manifold; and a cylinder sucked mass air quantity calculating section that calculates the cylinder sucked mass air quantity per a predetermined time $\Delta t$ by multiplying a cylinder volumetric air quantity per the predetermined time with a mass air quantity Cm within the intake manifold and by dividing a multiplied result of the cylinder volumetric air quantity per the predetermined time with the mass air quantity within the intake manifold with a volume of the intake manifold ($Cc=Vc \cdot Cm/Vm$).

15. An apparatus for calculating a mass air quantity sucked into one of cylinders of an internal combustion engine as claimed in claim 1, further comprising atmospheric pressure calculating section that calculates an air density ($\rho s$) from the finally calculated mass air quantity (Cms) during the stop of the engine divided by a volume of the intake manifold an d calculates the atmospheric pressure (H) on the basis of the air density.

16. An apparatus for calculating a mass air quantity sucked into one of cylinders of an internal combustion engine as claimed in claim 1, further comprising atmospheric pressure calculating section that calculates an air density ($\rho s$) from the finally calculated mass air quantity (Cms) during the stop of the engine divided by a volume (Vm) of the intake manifold and calculates the atmospheric pressure (H) on the basis of the air density ($\rho s$) and an intake air temperature (T).

17. An apparatus for calculating a mass air quantity sucked into one of cylinders of an internal combustion engine as claimed in claim 1, wherein the apparatus is applied to an automotive vehicle in which an idling revolution of the engine is stopped during a stop of the vehicle.

18. An apparatus for calculating a mass air quantity sucked into one of cylinders of an internal combustion engine, comprising:

cylinder sucked mass air quantity calculating means for calculating a mass air quantity sucked into a corresponding one of the cylinders of the engine on the basis of a mass air quantity within an intake manifold and a volume of the corresponding cylinder while performing income and outgo calculations between a mass air quantity flowing into the intake manifold and that flowing out from the intake manifold to calculate the mass air quantity within the intake manifold; and correction means for correcting the mass air quantity within the intake manifold calculated as a result of the income and outgo calculations of the mass air quantity during a stop of the engine on the basis of a crank angular position at a time at which the engine has stopped to calculate finally the mass air quantity within the intake manifold during the stop of the engine.

19. A method for calculating amass air quantity sucked into one of cylinders of an internal combustion engine, comprising:

performing income and outgo calculations between a mass air quantity flowing into an intake manifold and that flowing out from the intake manifold to calculate the mass air quantity within the intake manifold;

calculating a mass air quantity sucked into a corresponding cylinder of the engine on the basis of the mass air quantity within the intake manifold and a volume of the corresponding cylinder; and correcting the mass air quantity within the intake manifold calculated as a result of the income and outgo calculations of the mass air quantity during a stop of the engine on the basis of a crank angular position at a time at which the engine has stopped to calculate finally the mass air quantity within the intake manifold during the stop of the engine.

* * * * *